US005134423A

United States Patent [19]

Haupt

[11] Patent Number: 5,134,423

[45] Date of Patent: Jul. 28, 1992

[54] LOW SIDELOBE RESISTIVE REFLECTOR ANTENNA

[75] Inventor: Randy L. Haupt, Johnstown, Pa.

[73] Assignee: The United States of America as represented by the Secretary of the Air Force, Washington, D.C.

[21] Appl. No.: 617,715

[22] Filed: Nov. 26, 1990

[51] Int. Cl.[5] ..... H01Q 15/14

[52] U.S. Cl. ..... 343/912

[58] Field of Search ..... 343/912, 782, 907, 911 R

[56] References Cited

U.S. PATENT DOCUMENTS

| | | | |
|---|---|---|---|
| 3,156,917 | 11/1964 | Parmeggiani | 343/782 |
| 3,211,584 | 10/1965 | Ehrreich | 343/912 |
| 3,314,071 | 4/1967 | Lader et al. | 343/912 |
| 3,761,937 | 9/1973 | Ticoles et al. | 343/770 |
| 4,376,940 | 3/1983 | Miedema | 343/840 |
| 4,642,645 | 2/1987 | Haupt | 342/379 |
| 4,763,133 | 8/1988 | Takemura et al. | 343/912 |
| 4,994,818 | 2/1991 | Keilmann | 343/786 |

FOREIGN PATENT DOCUMENTS 63-278403 11/1988 Japan .

OTHER PUBLICATIONS

Bucci, Ovidio M. et al., "Control of Reflector Antennas Performance by Rim Loading", IEEE Transactions on Antennas and Propagation, vol. AP-29, No. 5 Sep. 1981, pp. 773-779.

Bucci, Ovidio M. et al., "Rim Loaded Reflector Antennas", IEEE Trans. Antennas Propagation, vol. AP-28, No. 3, 1980, pp. 297-305.

*Primary Examiner*—Michael C. Wimer

*Assistant Examiner*—Hoanganh Le

*Attorney, Agent, or Firm*—William G. Auton; Donald J. Singer

[57] ABSTRACT

Tapering the surface current density near the edges of a parabolic reflector antenna lowers the sidelobe level of the reflector. The current density is tapered by placing tapered resistive edge loads on the reflector for gradually decreasing the conductivity from the center of the reflector to the edge.

4 Claims, 6 Drawing Sheets

LOW SIDELOBE RESISTIVE REFLECTOR ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to radar systems and more specifically the invention pertains to a system which produces low sidelobe levels in reflector antennas. In radar systems, the system will suppress interference, using a reflective antenna with a resistive taper that generates desired bistatic scattering and backscattering patterns. Antenna synthesis techniques that relate the scattered field to the induced surface current density to get low sidelobes and nulls in the scattering patterns are used to design the resistive taper for different applications.

Scattering occurs when an electromagnetic wave impinges on an object and creates currents in that object which reradiate other electromagnetic waves. The electromagnetic wave may be of any frequency, but most of our every day encounters with scattering involve light. As technology advances, however, scattering from invisible spectrum, particularly microwaves, becomes more and more important. Public concerns involving the impact of microwaves on the environment and health, and military concerns involving very low sidelobe antennas and targets with a low radar cross section (RCS) point to a need for controlling the scattering of electromagnetic waves at microwave frequencies.

Current methods for constructing low sidelobe reflectors for radar systems include: phased array feeds, rim loading, shaping the reflector, and using subreflectors. Phased array feeds provide greater control over the sidelobe levels of the reflector, but are very expensive and large. For rim loading, constant resistive and impedance edge loads are placed on the rims of the reflector to reduce large current spikes at the edges of the reflector. Since the rim loads are a constant resistivity they provide only a limited control of the sidelobe level and lower, but don't eliminate, the current spikes at the edges.

Shaping the reflector entails rolling the edges of the reflector to help lower the sidelobe level. This does not provide a taper to the current density to produce very low sidelobes.

Finally, the use of subreflectors does reduce the blockage of the radiation, but this technique only provides limited control over the sidelobe levels.

The practice of rim loading reflector antennas to provide control over the performance characters of the antennas has been discussed in two articles by Ovidio Bucci et al:

Ovidio M. Bucci, et al., "Control of reflector antennas performance by rim loading," IEEE Trans. Antennas Propagat., vol. AP-29, no. 5, Sep 1981, pp. 773–779; and O.M. Bucci and G. Franceschetti, "Rim loaded reflector antennas," IEEE Trans. Antennas Propagt., vol. AP-28, no. 3, 1980, pp. 279–305. The disclosure of these articles is incorporated by reference, since they relate antenna surface impedance boundary conditions to the antenna's performance.

The task of reducing sidelobes is also alleviated, to some extent, by the systems disclosed in the following U.S. Patents, the disclosures of which are incorporated herein by reference:

U.S. Pat. No. 3,314,071 issued to Lader;
U.S. Pat. No. 3,156,917 issued to Parmeggiani;
U.S. Pat. No. 4,376,940 issued to Miedema; and
U.S. Pat. No. 4,642,645 issued to Haupt.

Currently, three primary methods exist to reduce microwave scattering from an object: covering it with an absorber, changing its shape, and detuning it through impedance loading. Absorbers convert unwanted electromagnetic energy into heat. An example of absorption is lining an anechoic chamber with absorbers. Changing the shape of the object channels energy from one direction to another, changes dominant scattering centers, or causes returns from various parts to coherently add and cancel the total return. Examples include rounding sharp edges, making an antenna conformal to the surface of an airplane, and serating the edges of a compact range reflector. Impedance loading alters the resonant frequency of an object. Examples include making a radome transparent to signals in the frequency band of the antenna and detuning the support wires of a broadcast antenna. Often, a combination of these techniques is necessary to reduce the scattering to an acceptable level. Although many scientific theories are available for analyzing scattering from objects, the process of reducing the scattering is presently as much an art as a science.

Of the three techniques, absorbers have the most attractive features. They have a broad bandwidth, attenuate the return in many directions, and may be used to reduce scattering from an object after the object is designed. In contrast, shaping an object does not reduce the scattering in all directions, may not even be possible once the object is past the design stage, and may not reduce the scattering to desired levels. Impedance loading is inferior because it has a narrow bandwidth, is not usually feasible past the design stage, and is not practical for large reflecting surfaces.

Absorbers have low scattering levels because they convert most of the incident electromagnetic energy into heat and only a small percentage is reflected or transmitted. In the absorber the amount of energy converted into heat (absorbed) depends on the size of the imaginary part of the index of refraction. The higher the imaginary part, the more energy the material absorbs.

SUMMARY OF THE INVENTION

The present invention includes a parabolic dish antenna which has a tapered resistive edge load. The eletrooptical characteristics of the tapered resistance occurs because the antenna dish is actually composed of a dielectric which has a tapered metallic coating on its concave surface. A dielectric is a material which has an electrical conductivity which is low in comparison to that of a metal. Suitable dielectrics include: silicon, ceramics, fiberglass and plastics.

When the tapered metallic coating is applied, it will provide the antenna with a reflective coating which has a low resistivity where the entire dielectric is covered, and progressively higher resistivity as less metal is deposited. Therefore the antenna dish is completely covered at the center of the dish, while the metallic coating is diminished to next to nothing at the perimeter of the antenna.

In one embodiment of the invention, a dielectric antenna dish structure is produced, then a reflective coating with a resistive taper is fixed thereon. This resistive taper is made by covering areas of the dielectric entirely with a metal reflective coating where low resistivity is required, and with progressively less metal where higher electrical resistivity is required. The metal reflective coating can be made from such conductive metals as aluminum, copper, steel, iron, gold and silver. These metals may be applied using deposition techniques that include: sputtering, evaporation, electrodeposition and spray painting. When the dielectric antenna disk structure has a metal coating density of 100% at the center, and a metal coating density which diminishes to zero as one progresses the perimeter of the disk, the reflective sidelobes are also reduced.

The object of this invention is to synthesize resistive tapers for the antenna that produce desired bistatic scattering and backscattering patterns.

It is another object of the invention to provide a fabrication process to produce parabolic reflective antennas which have tapered resistive end loads.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a technique to synthesize resistive tapers on the surface of an antenna so that the antenna produces desired bistatic scattering and back scattering patterns.

Figure 1:
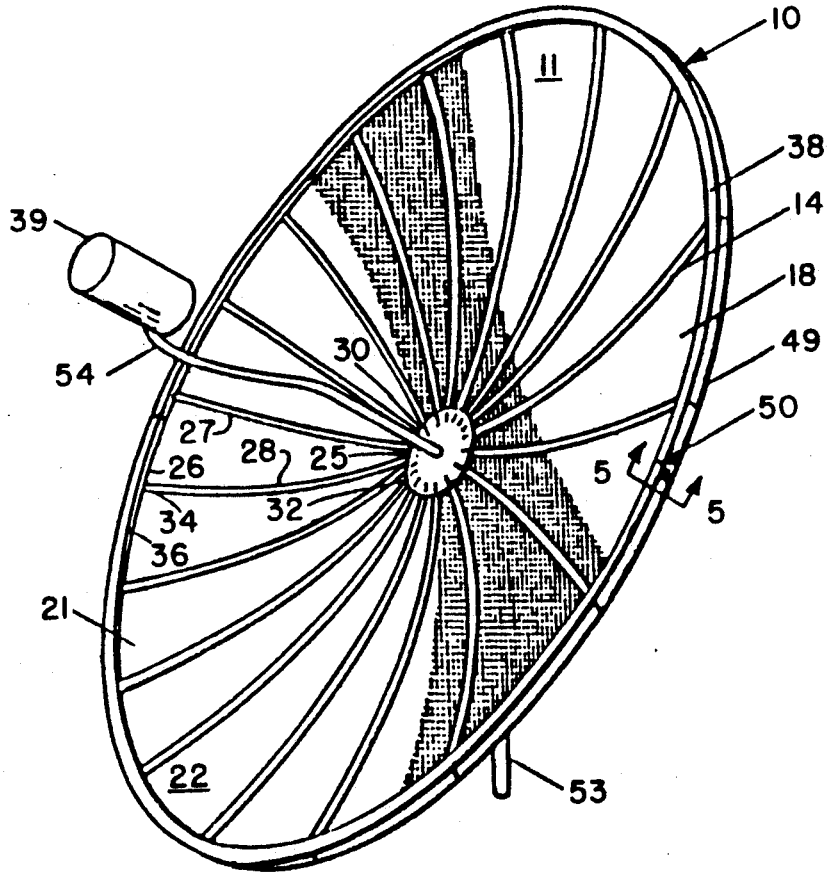
FIG. 1 (PRIOR ART)
FIG. 1 is a prior art reflector antenna.

FIG. 1 is an illustration of a prior art parabolic reflector antenna described in U.S. Pat. No. 4,710,777, the disclosure of which is incorporated by reference. In FIG. 1, the antenna panels 18 reflect incident radio frequency signals into the pickup probe 39. All of the panels 18 are uniformly composed of a conventional reflective material. All metals or continuous metalized surfaces are suitable as microwave reflectors. Aluminum and steel are the metals most usually employed because of their structural properties. A smooth continuous metallic surface is an ideal reflector, but grids and screens are widely employed to reduce the weight and wind resistance of the antenna. The present invention replaces the panels which have a uniform reflective surface with a synthesized resistive taper designed as described below. The principles behind amplitude edge tapering are discussed in a related application by Haupt, Ser. No. 07/570,670, now U.S. Pat. No. 5,017,9.

Figure 2:
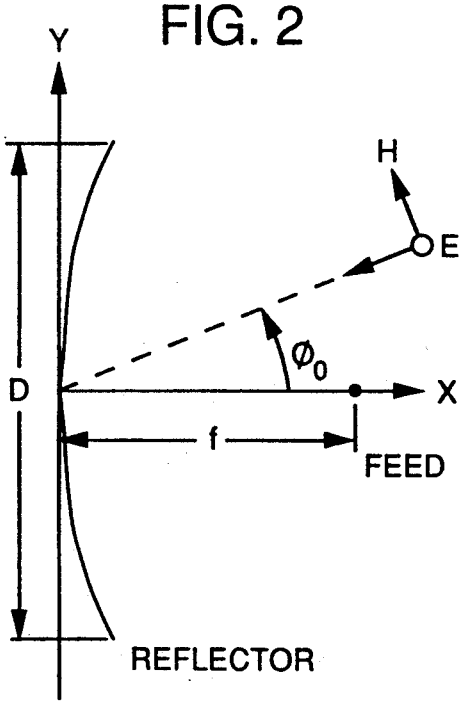
FIG. 2 is a diagram of the reflector antenna, in which: D is the diameter, f the focal length, $\phi_o$ the incident angle, $\overline{E}$ is the electric field, and $\overline{H}$ is the magnetic field.
Figure 3:
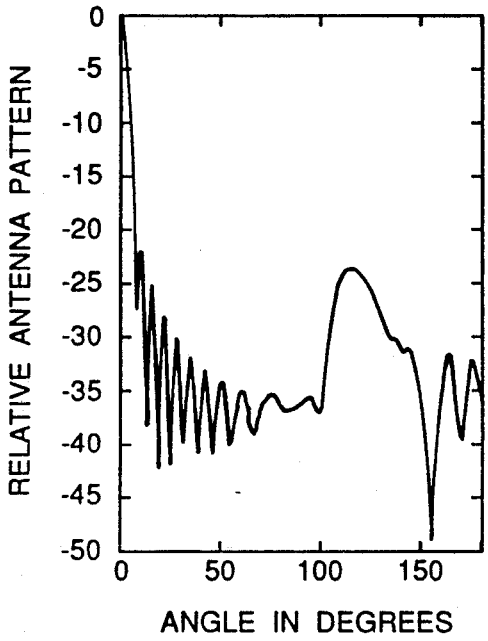
FIG. 3 is a chart of the far field pattern of a perfectly conducting reflector with D=10 wavelengths and f=5 wavelengths.

FIG. 2 is a diagram of a parabolic cylinder antenna. The antenna is perfectly conducting, has a line source feed at the focal point a distance f from the vertex, and has a diameter D. A plane wave is incident on a reflector at an angle $\phi_o$. $\overline{E}$ is the electric field and H is the magnetic field. When the reflector is 10 wavelengths in diameter, and the focal length is 5 wavelengths, the reflector has the resulting antenna pattern shown in FIG. 3.

Figure 4:
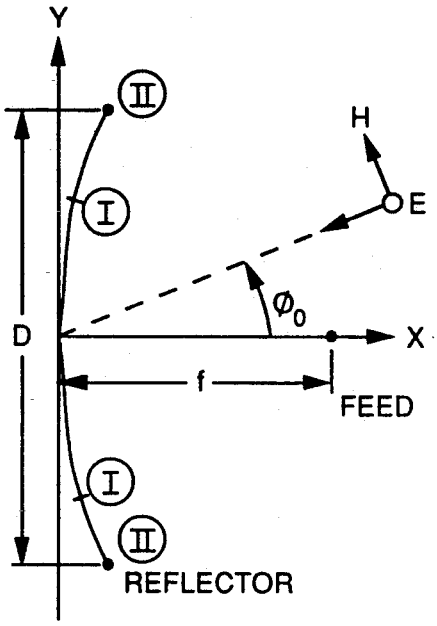
FIG. 4 is a diagram of the reflector antenna with a resistive taper, Point I is where the taper begins (minimum value of resistive taper), and Point II is where the taper ends (maximum value of resistive taper)

FIG. 4 shows the reflector antenna with a tapered resistive load at the edges. The resistivity is zero at point I and a maximum value at point II. One possible resistive taper is $$R(d) = b\left(\frac{d}{B}\right)^2$$

where d=distance from point I to a point on the resistive load b=maximum resistivity at point II B=length of the resistive taper The resistive taper results from depositing metal on a thin dielectric. Coating the entire dielectric with metal produces a very low resistivity. Depositing less metal produces higher resistivities.

Figure 5:
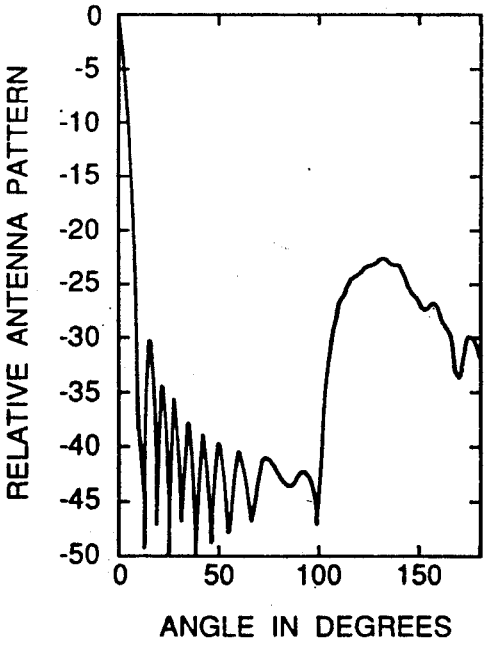
FIG. 5 is a chart of the far field pattern of a fully tapered reflector with D=10 wavelengths and f=5 wavelengths, the resistivity is resistivity is zero at the vertex and increases as the square of the distance to a maximum value of 189 at the edges.
Figure 6:
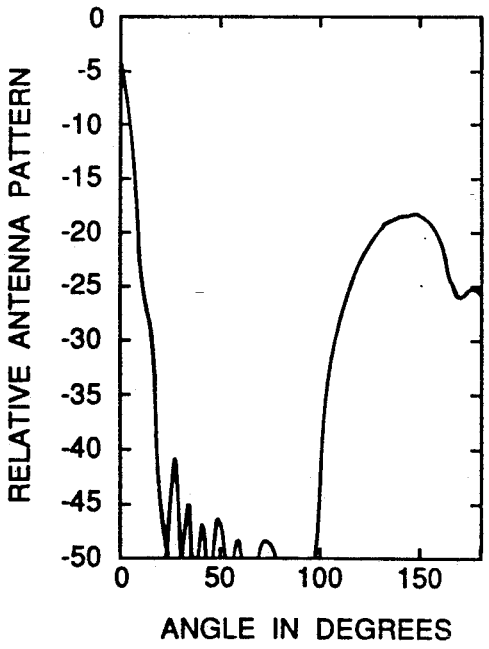
FIG. 6 is a chart of the far field pattern of a fully tapered reflector with D=10 wavelengths and f=5 wavelengths, the resistivity is resistivity is zero at the vertex and increases as the square of the distance to a maximum value of 754Ω at the edges.

A long resistive taper allows more control over the sidelobe level but decreases the gain of the antenna and produces a large spill-over/transmission sidelobe. A short resistive taper has a smaller amount of control over the sidelobe level, but has little effect on the gain and has a smaller spill-over/transmission sidelobe. FIG. 5 shows the far field pattern of a reflector having a resistive taper that gradually increases from zero at the vertex to R-189 at the edges. Note that the sidelobe level decreases relative to the main beam up to angles of 100°, but the main beam gain becomes smaller and the spill-over/transmission sidelobe becomes larger (FIG. 6). Tapering the entire reflector surface provides very low sidelobes in the front half space of the antenna; however, the gain is significantly reduced, and the sidelobe level in the back half space of the antenna goes up. Tapering the entire surface is appropriate when extremely low sidelobes are necessary in the front half space, and the back half space is not important (satellite antennas) or absorber can be placed behind the dish.

Figure 7:
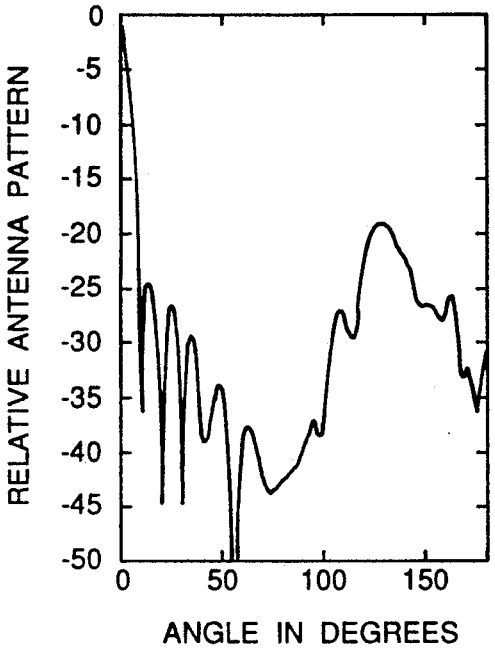
FIG. 7 is a chart of the far field pattern of an edge-loaded reflector with D=10 wavelengths and f=5 wavelengths, the resistivity is zero from the vertex to two wavelengths from the edge The final two wavelengths of the reflector has a resistivity of 37Ω.

FIG. 7 shows the far field pattern due to a constant resistive edge load (R=377Ω) 2 wavelengths long. Lumped resistive loads at the edges are currently used to reduce sidelobe levels of reflectors.

Figure 8:
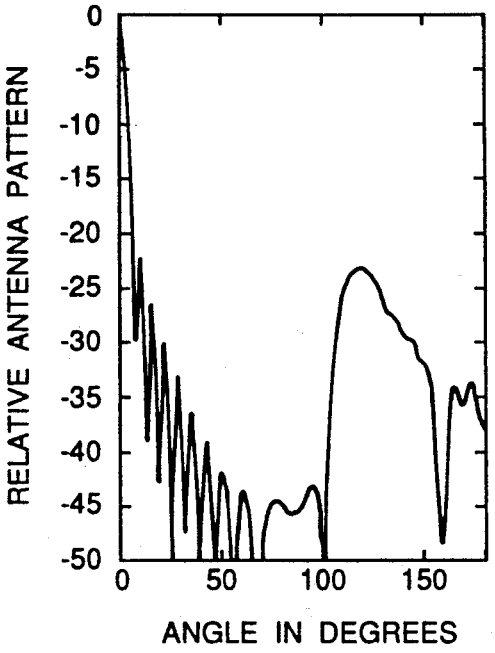
FIG. 8 is a chart of the far field pattern of a tapered edge-loaded reflector with D=10 wavelengths and f=5 wavelengths, where the resistivity is zero from the vertex to one wavelength from the edge and the final wavelength of the reflector has a tapered resistivity that starts at zero and increases to 377Ω at the edges.
Figure 9:
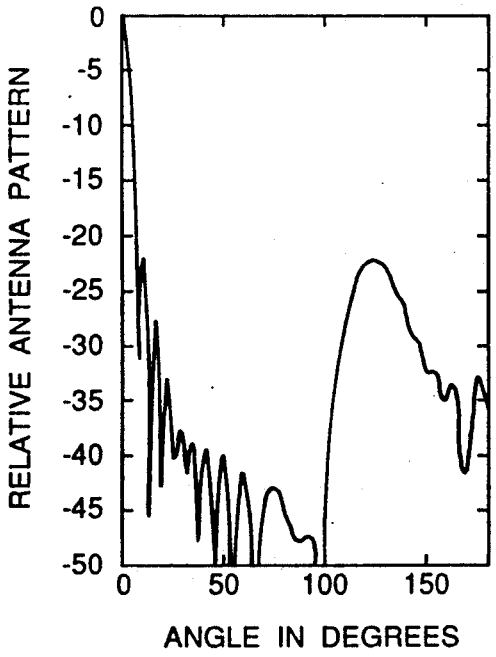
FIG. 9 is a chart of the far field pattern of a tapered edge-loaded reflector with D=10 wavelengths and f=5 wavelengths. The resistivity is zero from the vertex to two wavelengths from the edge, where the final two wavelengths of the reflector have a tapered resistivity that starts at zero and increased to 377Ω at the edges.

FIG. 8 shows the far field pattern due to a tapered resistive edge load (b=377Ω) and B=1 wavelength long. The far field pattern in FIG. 8 is superior to the far field pattern in FIG. 6, because it has a higher gain, lower sidelobes, and lower spill-over/transmission sidelobes. Varying b and B provides control over the gain and sidelobe level. FIG. 9 shows the far field pattern when b=377Ω 1 and B is 2 wavelengths long. This antenna pattern shows some improvement in the sidelobe levels of the previous case but has a lower gain and higher spill-over/transmission sidelobe. This antenna pattern is also superior to the antenna pattern shown in FIG. 7.

As described above, the new feature is the tapered resistive edge load vs. the constant resistive edge load. The advantage is the ability to have greater control over the antenna pattern. A resistive edge load produces an antenna pattern with higher gain, lower sidelobes, and a lower spill-over/transmission sidelobe than the constant resistive edge load. The discussion that follows describes the details of fabricating reflector antenna panels with resistive tapers on their surfaces so the antenna produces desired scattering of RF signals.

Figure 10:
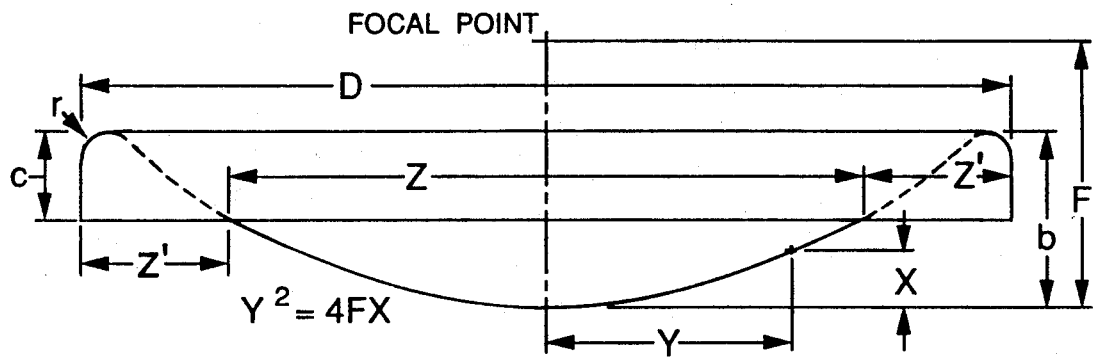
FIG. 10 is an illustration of the pertinent dimensions of a parabolic reflective antenna.

FIG. 10 is an illustration of an example of a parabolic dish antenna with dimensions which are given below in Table 1. In all instance, the term Z represents the center annular reflective surface of the parabola while $Z^1$ represents the outer concentric annular ends the parabola. When the dish antenna is composed of metal covered dielectric, the present invention provides maximum resistivity at the ends (denoted by $Z^1$) and low resistivity at the center annular reflective surface (denoted by Z) as discussed below.

TABLE 1

| Dimensions for Paraboloids | | | | | |
|---|---|---|---|---|---|
| D, in. | b, in | c, in. | r, in. | F, in. | Gauge # |
| 4 | 0.80 | 3/8 | 1/8 | 1.3 | 18 |
| 8 | 1.20 | 7/16 | 1/8 | 2.0 | 18 |
| 10 | 1.74 | 7/16 | 1/8 | 3.6 | 18 |
| 12 | 2.50 | 9/16 | 1/8 | 3.6 | 18 |
| 16 | 2.96 | 5/8 | 1/8 | 5.4 | 18 |
| 18 | 3.40 | 3/4 | 1/8 | 6.0 | 18 |
| 18 | 3.75 | 3/4 | 1/8 | 5.4 | 18 |
| 20 | 4.63 | 3/4 | 1/8 | 5.4 | 18 |
| 24 | 4.50 | 3/4 | 1/8 | 8.0 | 16 |
| 24 | 5.00 | 3/4 | 1/8 | 7.2 | 16 |
| 30 | 5.30 | 3/4 | 1/8 | 10.6 | 16 |
| 30 | 5.60 | 3/4 | 1/8 | 10.0 | 16 |
| 40 | 8.30 | 7/8 | 1/8 | 12.0 | 16 |
| 48 | 9.94 | 1.0 | 1/4 | 14.5 | 14 |
| 72 | 15.40 | 1.5 | 3/8 | 21.1 | 3/32 |
| 120 | 25.10 | 2.5 | 1/2 | 35.8 | 1/8 |

The reader's attention is directed towards FIG. 10 with the following comments. As mentioned above, the present invention provides a reflector antenna which differs from the uniform antenna of FIG. 1 by providing a resistive taper pattern to the reflective surface. More specifically, the antenna panels are composed of dielectric with a resistive taper pattern formed by a deposit of metal on the surface. In the center annular reflective surface (denoted by Z) the entire dielectric is completely covered by a reflective metal to provide low resistivity. The outer concentric annular ends $Z^1$ have a pattern where less metal is deposited as one approaches the perimeter of the antenna.

Any suitable dielectric or nonconductive medium is suitable as an antenna panel. These dielectrics can include, but are not limited to: silicon, plastic, ceramics, and fiberglass As mentioned above, reflective metals are normally used and include: aluminum, copper, steel, iron, gold and silver. The metals may be applied to the dielectric by sputtering with the following guidelines. As mentioned above, the center reflective surface Z should be completely covered with metal. As shown in the example of FIGS. 2–10, the area of Z covers approximately the inner ⅔ of the reflective surface, but this amount can be varied. The outer ⅓ of the antenna is characterized by a gradual decrease in the metal coating as one progresses towards the perimeter of the antenna. This can be a linear decrease in metal ranging from 100% of coverage (at the border between Z and $Z^1$) and 0% coverage at the perimeter of the antenna.

Just as the actual size of the dish antenna will depend on its application, the various tapering schemes of adjusting the reflector surface resistivity will also be varied by the application. These variations may be determined by the user of the present invention with several sources of guidance. First the selection of a proper parabolic reflector antenna configuration may be made using such standard references as "The Antenna Engineering Handbook" by Henry Jasik and published by the McGraw Hill book company in 1961, the disclosure of which is incorporated herein by reference. Second, the characteristics of resistive tapers in the presence of incident RF energy is the optic of a detailed technical report entitled "Synthesis of Resistive Tapers to Control Scattering Patterns of Strips" by Randy Haupt et al and published by the University of Michigan in September 1988 as RADC-TR-88-198, the disclosure of which is incorporated by reference. The Haupt reference describes RF measurements made from a resistive taper that generates desired bistatic scattering patterns from a strip, and is a valuable reference.

The manufacturing process of a reflective antenna of the present invention begins with the present invention begins with the fabrication of a dielectric antenna structure. The structure may be a complete parabolic dish which is span in accordance with the dimensions described for FIG. 10, or may be a plurality of panels which are fixed to the ribs depicted in FIG. 1.

Next a diameter for the center annular reflective surface is selected. This portion of the antenna should have low resistivity and will be completely covered with a metallic reflective coating. The value for the diameter can range between one half and ¾ of the diameter of the antenna. As described above, the remainder of the antenna forms the outer concentric annular ends of the antenna dish.

The center annular reflective surface of the concave side of the dish (or individual panels) is next covered completely with a metallic reflective coating using one of the following conventional techniques: sputtering, evaporation, electrodeposition, eatectics, or spray painting. Sputtering is a process depositing a thin metal film on the dielectric substrate as follows. First, the substrate is placed in a large demountable vacuum chamber which has a cathode which is made of the metal to be sputtered. Next, the chamber is operated to bombard the cathode with positive ions. As a result, small particles of the metal fall uniformly on the dielective substrate.

As discussed above, the center annular reflective surface of the concave side of the dish (or panels) is covered completely with metal. The outer concentric annular ends are coated with metal which diminishes from 100% to 0% as one progresses outwards towards the perimeter of the antenna. The gradual diminution of the density of the metal coatings is believed to be a conventional achievement which is described in texts such as "Electrochemistry" by Edmund C. Potter and "Metal-Semiconduction Contacts," by E.H. Rhoderick, the disclosures of which are incorporated by reference. In the sputtering example discussed above, the cathode would be located at the center of the dish antenna, and sputtering begun while masking the outer concentric annular ends of the dish. Once the center annular reflective surface of the dish is substantially covered with metal, the mask would be removed. This would allow the inner most portion of the outer concentric annular ends to get a heavier dosage of metal then the perimeter, and the coating of metal is progressively lighter as one proceeds outwards on the surface of the antenna.

The majority of metal contacts on dielectric substrates are made by evaporation. Most of them are made in a conventional vacuum system pumped by a diffusion pump giving a vacuum around $10^{-5}$ Torr, often without a liquid-nitrogen trap. This method of depositing metal films has been extensively developed. The lower-melting-point metals such as aluminum and gold can usually be evaporated quite simply by resistive heating from a boat or filament, while the refractory metals like molybdenum and titanium are generally evaporated by electron-beam heating. Most frequently the semiconductor surface is prepared by chemical etching, and this invariably produces a thin oxide layer of thickness about 10–20 Angstrom; the precise nature and thickness depend on the exact method of preparing the surface. The effect of surface preparation on the characteristics of silicon Schottky barriers has been discussed by Rhoderick. Interfacial layers can also be caused by water or other vapour adsorbed onto the surface of the semiconductor before insertion into the vacuum system. Such absorbed layers can usually be removed by heating the substrate to between 100 degrees Celsius and 200 degrees Celsius prior to evaporation.

The antenna dish which has been fabricated by the steps of the process recited above has a low resistivity in the center annular reflective surface, and a tapered resistance in the outer concentric annular ends of the dish. The above-cited Haupt et al reference provides insights as to the nature of reflected RF energy from a tapered resistance surface, and can provide some additional guidance as to the appropriate taper of a resistance for an antenna designer. However, users of the invention may have to empirically determine the optimum diameter for the center annular reflective surface as well as the characteristics of the resistance tapering to be applied to the outer concentric annular ends within the guidelines provided above. These optimum features will change with different applications, just as the size of the antenna dish will change with different applications. A general rule of thumb is that the size of the parabolic antenna will be about one quarter of the wavelength of the received signals, but the selection of size is not mandatory to practice the invention as described above.

The low sidelobe antenna system of the present invention is a parabolic antenna reflector which has a tapered resistive surface. There are some design guidelines that allow one to synthesize a resistive surface. There are some design guidelines that allow one to synthesize a resistive taper that will result in far field antenna patterns with sidelobes at a predetermined level. These design guidelines are discussed below.

The antenna of FIG. 2 is a cylindrical parabolic reflector lying in the x-y plane with a single line feed parallel to the z-axis at the focal point. A plane wave incident at an angle of $\phi_o$ (measured) from the positive x-axis) excites a current on the reflector surface that flows in the z-direction. The induced current density is found by numerically solving the following integral equation for $J_z$:

$$e^{j2\pi(x\cos\phi_o+y\sin\phi_o)} = \eta(\rho)J_z(\rho) + \frac{\pi}{2}\int_C J_z(\rho')H_o^{(2)}(2\pi|\rho-\rho'|)d\rho' \quad (1)$$

where x, y, p,p' have units of wavelengths $\eta$=resistivity normalized to the impedance of free space $\bar{p}$=location of observation point p'=location of source point on the reflector surface $J_z$=z-directed current density C=integration path along the reflector surface $H_o^{(2)}()$=zeroth order Hankel of the second kind This current in turn radiates a scattered field, part of which is detected by the feed. The total electric field at the feed is given by:

$$E^f = \frac{\pi}{2}\int_C J_z(\rho')H_o^{(2)}\left(2\pi\sqrt{(x_m-x_f)^2+(y_m-y_f)^2}\right)d\rho' + \quad (2)$$

-continued $$\delta(\phi_o)\, e^{j2\pi(x_f\cos\phi_o + y_f\sin\phi_o)}$$

where $(x_m, y_m)$ are the segment midpoints on the parabola $(x_f, y_f)$ is the location of the feed element $\delta(\phi_o, f)$ is the blockage factor $\phi_o$ is the incident field angle The first term on the right-hand side of Equation 2 is the field scattered by the reflector surface, and the second term is the incident field. The feed receives the incident field directly when it is not blocked by the reflector surface. Blockage angles of the feed are given by:

$$\phi_{b1,2} = \tan^{-1}\left(\frac{y_{end} - y_f}{x_{end} - x_f}\right) \tag{3}$$

where $(x_{end}, y_{end})$ is the endpoint of the reflector,

Consider a reflector that has a diameter of 10λ, a focal length of 5 , and a feed with an electric field pattern given by:

$$E(\phi) = \begin{cases} z\cos^2\phi & 90^\circ \leqq \phi \leqq 270^\circ \\ 0 & \text{elsewhere} \end{cases} \tag{4}$$

Figure 11:
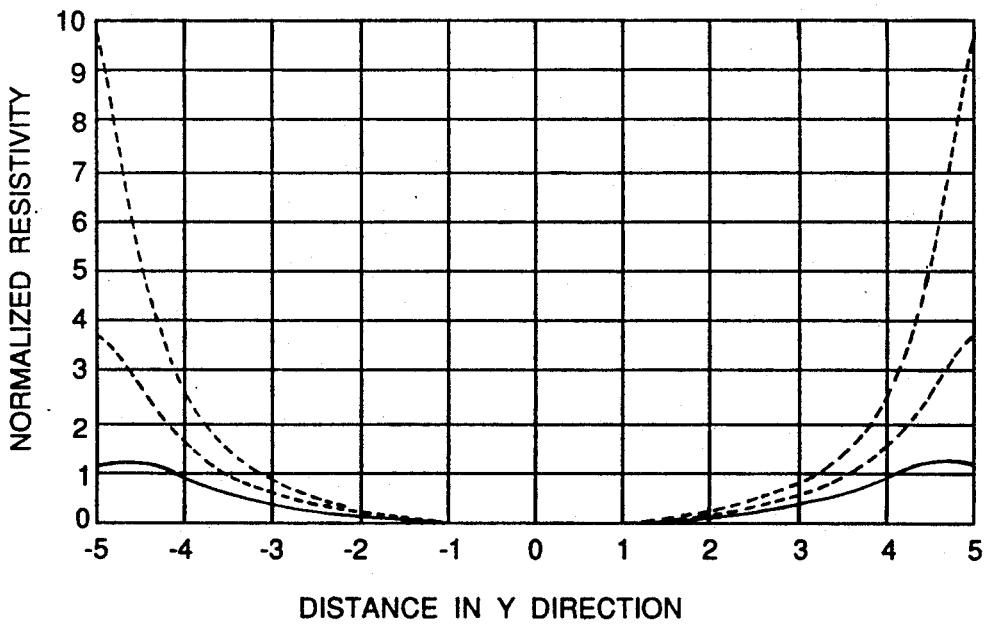
FIG. 11 is a chart depicting resistive tapers for an $\bar{n}=9$ Taylor distribution and sidelobe levels of 30 dB (solid), 40 dB (dashed), and 50 dB (dot-dash)

The far field pattern for this antenna with a perfectly conducting reflector surface appears in FIG. 11. Its first sidelobe is 22 dB below its main beam peak. A rather large sidelobe occurs at 114 degrees, because the feed radiation spills over the reflector edge at that point.

The goal is to develop a resistive taper for the reflector surface that produces desirable sidelobe levels. If the reflector were flat, then techniques exist to derive a current distribution on the reflector that will produce desired sidelobe levels. Taking such a current distribution and projecting it back onto the parabolic reflector surface gives a current distribution for the parabolic reflector. This projected current distribution does not produce the same sidelobe levels as for the flat reflector because the reflector is curved. The projected current distribution on the reflector can be related to a resistive taper via a physical optics equation given by:

$$\eta(x_m, y_m) = \frac{1}{J_z(x_m, y_m)}\, e^{jk(x_m\cos\phi' + y_m\sin\phi')} - \frac{1}{2\sin\phi'} \tag{5}$$

where $J_z$=projected current density on reflector surface $\eta$=normalized resisitivty $(x_m, y_m)$=points on the reflector surface $\phi' = \phi_o - \phi_s$ $\phi_o$=angleo of incident field from feed $$\phi_s = a\cos\left(\frac{[x_{i+1} - x_i]}{\Delta}\right)$$

The reflector is divided into N segments each Δ long. $(x_i, y_i)$ and $(x_{i+1}, y_{i+1})$ are the endpoints of the segments.

Once this resistive taper is found, the far field pattern is calculated using the method of moments.

Figure 12:
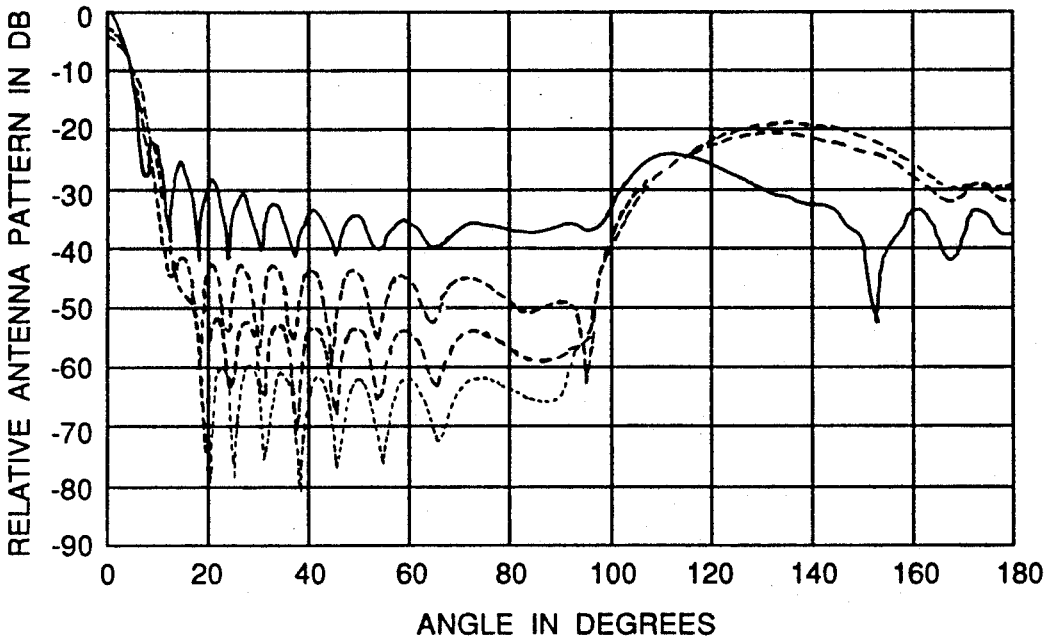
FIG. 12 is a chart of antenna patterns of a two-dimensional parabolic reflector having a diameter of 10λ, a focal length of 5λ, and a feed pattern given by equation (4). The reflector has resistive tapers that correspond to the tapers shown in FIG. 11: 30 dB Taylor (solid), 40 dB Taylor (dashed), 50 dB Taylor (dot-dash), and perfectly conducting reflector (dotted)
Figure 13:
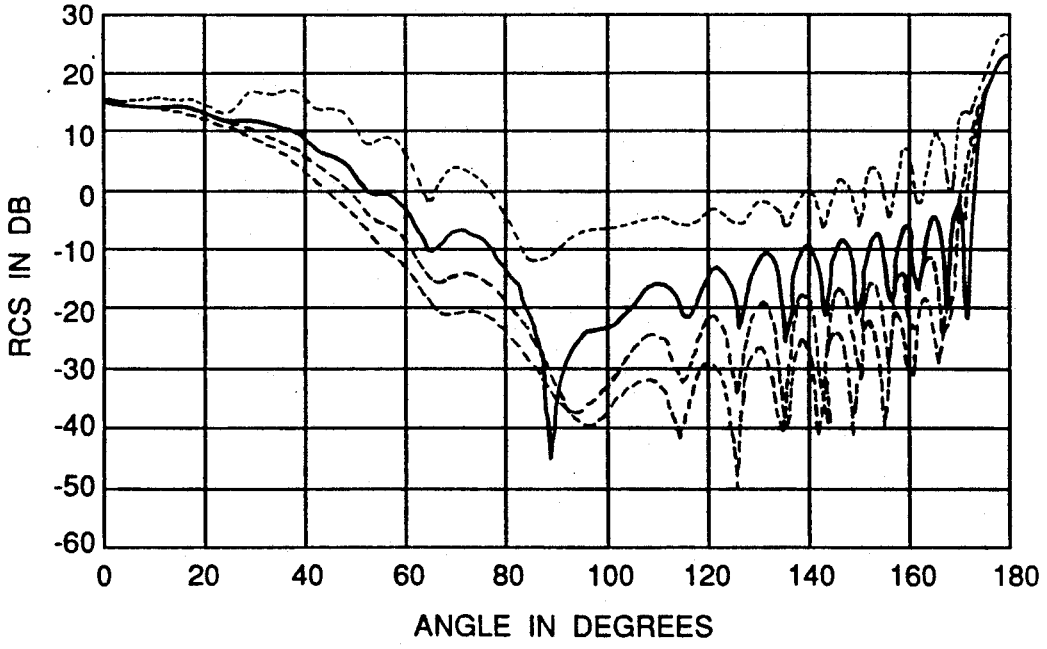
FIG. 13 is a chart of bistatic scattering (electromagnetic plane wave incident at $\phi_o=90°$) patterns of a two-dimensional parabolic reflector having a diameter of 10λ, a focal length of 5λ, and a feed pattern given by equation (4). The reflector has resistive tapers that correspond to the tapers shown in FIG. 11: 30 dB Taylor (solid), 40 dB Taylor (dashed), 50 dB Taylor (dot-dash), and perfectly conducting reflector dotted.

The examples shown here project a Taylor current distribution onto the reflector surface, calculate the resistive taper using physical optics, then calculate and plot the far field pattern. FIG. 12 shows the calculated values for the resistive tapers corresponding to Taylor current distributions with $\bar{n}=9$ and sidelobe levels of −30, −40, and −50 dB below the peak of the main beam. The corresponding far field patterns are shown in FIG. 11. Note that the far field patterns have maximum sidelobe levels that are nearly 10 dB lower than specified by the taper. This result is expected, because the uniform taper on the reflector has a maximum sidelobe level nearly 10 dB below that of a uniform flat reflector. FIG. 13 also shows a rather large spillover/transmission sidelobe between 100 degrees and 180 degrees. These large lobes are due to transmission of the incident wave through the reflector surface.

The reflector may be built by sputter depositing a highly conducting metal onto a parabolic shaped thin dielectric. The deposited metal becomes thinner as the resistivity increases. The metal is deposited in such a manner as to correspond to the resistive tapers derived from Equation 4. The resistivity may be checked via four-point-probe measurements or network analyzer measurements.

The new feature of the present invention includes the ability to synthesize resistive tapes for the reflector surface that result in specified sidelobe levels.

The advantage is the ability to have greater control over the antenna pattern. Previous attempts at resistive tapers and absorbing loading cannot yield predetermined sidelobe levels.

Figure 14:
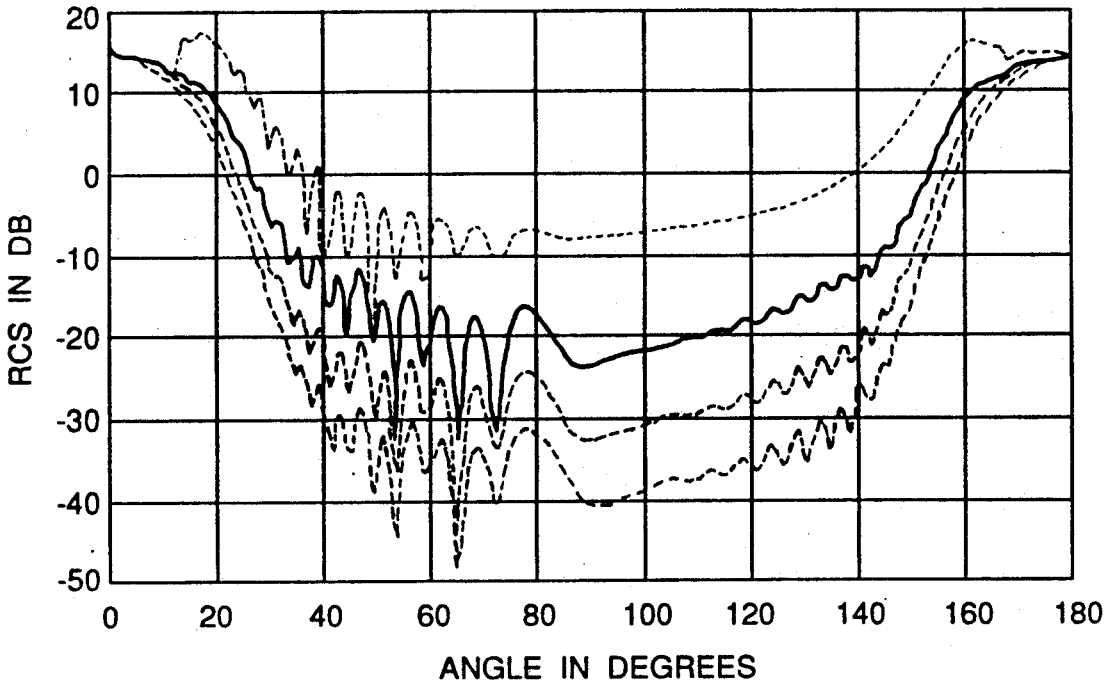
FIG. 14 is a chart of back scattering patterns of a two-dimensional parabolic reflector having a diameter of 10λ, a focal length of 5λ, and a feed pattern given by equation (4). The reflector has resistive tapes that correspond to the tapers shown in FIG. 11: 30 dB Taylor (solid), 40 dB Taylor (dashed), 50 dB Taylor (dot-dash), and perfectly conducting reflector (dotted).

These tapers result in bistatic scattering and backscattering patterns with low sidelobe levels. Thus, the radar cross-section of these antennas are reduced as shown in FIGS. 13 and 14. A reduced radar cross section makes the antenna less detectable by radar.

While the invention has been described in its presently preferred embodiment it is understood that the words which have been used are words of description rather than words of limitation and that changes within the purview of the appended claims may be made without departing from the scope and spirit of the invention and its broader aspects.

What is claimed is:

1. A process for fabricating an antenna disk with a center and an outer edge which has a tapered resistive edge load, said process comprising the steps of:

producing an antenna disk composed of dielectric, wherein said antenna disk has a center annular reflective surface which has a radius which ranges between one half and three quarters of the radius of the antenna dish and wherein said center annular reflective surface has a coating density of 100% of a metallic reflective coating; and fixing a reflective coating on said antenna disk, wherein said fixing step includes providing said metallic reflective coating on said dielectric with a tapered coating comprising covering areas of said dielectric entirely with said metallic reflective coating where low resistivity is required for said resistive taper, and covering areas of said dielectric with less metal at the outer edge of the antenna dish where high resistivity is required for said resistive taper wherein said tapered coating of said metallic reflective coating comprises a diminution of coating thickness and density in the metallic coating as one progresses towards the outer edge of the antenna dish, said diminution comprising a coating density which is near 100% at the center of the antenna dish, and which diminishes with a correlation to physical distance as one approaches the outer edge of the antenna dish wherein said fixing step is performed by deposition techniques that include: sputtering, evaporation, electrodeposition, and spray painting said metallic reflective coating onto said antenna dish structure; and wherein metallic reflective coating is made from metals selected from the group consisting of: aluminum, copper, steel, iron, gold and silver.

2. A process as defined in claim 1, wherein said tapered coating of said metallic reflective coating comprises a liner diminution of the metallic coating as one progresses towards the perimeter of the antenna dish, said linear diminution comprising a coating density which is near 100% at a border between the center annular reflective surface and the outer annular reflective surface, and which diminishes with a linear correlation to physical distance as one approaches the perimeter of the antenna dish.

3. A parabolic antenna which has a tapered resistive edge load, said parabolic antenna comprising:

a dielectric antenna dish structure which has a parabolic shape with a concave side which has a center and an outer edge and a convex side, wherein said dielectric antenna dish structure is composed of materials selected from the group consisting of: plastic silicon, ceramics, and fiberglass; and a metallic reflective coating which has been applied to the concave side of the dielectric antenna dish with a tapered coating to provide thereby said tapered resistive edge load, wherein said tapered coating of said metallic reflective coating comprises a diminution in density and thickness of the metallic coating as one progresses towards the outer edge of the dielectric antenna dish said diminution comprising a coating density which is near 100% at the center of the concave side, and which diminishes with a linear correlation to physical distance as one approaches the outer edge of the concave side of the parabolic antenna dish structure; and wherein said parabolic antenna has a center annular reflective surface with a 100% density in said metallic reflective coating and a radius which ranges between one half and three quarters of the radius of the antenna dish structure.

4. A parabolic antenna, as defined in claim 3, wherein said metallic reflective coating comprises a sprayed coating of steel which is uniformly distributed to completely cover said center annular reflective surface, and applied with said tapered coating on said outer annular reflective surface.

* * * * *